US009129457B2

(12) United States Patent
Sumcad et al.

(10) Patent No.: US 9,129,457 B2
(45) Date of Patent: Sep. 8, 2015

(54) ELECTRONIC DOOR LOCK WITH MODULAR COMPONENTS

(75) Inventors: Gustavo L. Sumcad, Westfield, IN (US); Ronald Taylor, Wheaton, IL (US); James W. Brown, Westfield, IN (US); Peter M. Dance, Fishers, IN (US); James R. Jackson, Westfield, IN (US)

(73) Assignee: Schlage Lock Company, Carmel, IN (US)

( * ) Notice: Subject to any disclaimer, the term of this patent is extended or adjusted under 35 U.S.C. 154(b) by 661 days.

(21) Appl. No.: 13/055,171

(22) PCT Filed: Jun. 8, 2009

(86) PCT No.: PCT/US2009/046628

§ 371 (c)(1),
(2), (4) Date: Jul. 8, 2011

(87) PCT Pub. No.: WO2009/158181

PCT Pub. Date: Dec. 30, 2009

(65) Prior Publication Data

US 2011/0252843 A1 Oct. 20, 2011

Related U.S. Application Data

(60) Provisional application No. 61/076,476, filed on Jun. 27, 2008.

(51) Int. Cl.
*E05B 41/00* (2006.01)
*G07C 9/00* (2006.01)
(Continued)

(52) U.S. Cl.
CPC ..... *G07C 9/00896* (2013.01); *E05B 47/00* (2013.01); *E05B 63/0056* (2013.01);
(Continued)

(58) Field of Classification Search
USPC ..... 70/221–223, 277, 278.1, 279.1, 280, 70/472; 340/5.2, 5.64
See application file for complete search history.

(56) References Cited

U.S. PATENT DOCUMENTS

| | | | | |
|---|---|---|---|---|
| 5,841,347 | A * | 11/1998 | Kim | 70/278.1 |
| 5,894,277 | A * | 4/1999 | Keskin et al. | 70/278.1 |
| 6,655,180 | B2 * | 12/2003 | Gokcebay et al. | 70/278.1 |
| 6,714,118 | B1 * | 3/2004 | Frolov et al. | 70/279.1 |
| 6,876,293 | B2 * | 4/2005 | Frolov et al. | 70/278.2 |
| 7,336,150 | B2 * | 2/2008 | Gokcebay et al. | 70/278.1 |

(Continued)

FOREIGN PATENT DOCUMENTS

| | | |
|---|---|---|
| CN | 1468342 | 1/2004 |
| DE | 102005034325 A1 | 3/2006 |
| EP | 1213417 A | 6/2002 |

OTHER PUBLICATIONS

Office Action from the State Intellectual Property Office of the People's Republic of China for Application No. 200980133970.6 dated Oct. 26, 2012 (English Translation Only, 15 pages).

*Primary Examiner* — Christopher Boswell
(74) *Attorney, Agent, or Firm* — Michael Best & Friedrich LLP

(57) ABSTRACT

An electronic door lock mounts to a door and includes an inner side and an outer side. The electronic door lock is operable to control access to an access controlled area positioned adjacent the inner side of the door. The electronic door lock includes an outer base connected to the outer side of the door, an inner base connected to the inner side of the door, a locking mechanism coupled to the door and movable between a locked position and an unlocked position in response to a control signal, and a control circuit disposed within the inner base and operable to generate the control signal in response to an input credential. An attachment interface is at least partially formed as part of the outer base. Each of a plurality of different types of credential readers is selectively attachable and removable from the attachment interface when the outer base is attached to the door to electrically connect a selected one of the plurality of different types of credential readers to the control circuit to provide the input. A communication module is connected to the control circuit, and the communication module is operable to communicate with a device that is separate from the electronic door lock.

19 Claims, 9 Drawing Sheets

(51) Int. Cl.
*E05B 47/00* (2006.01)
*E05B 63/00* (2006.01)

(52) U.S. Cl.
CPC ..... *G07C9/00944* (2013.01); *Y10T 70/5155* (2015.04); *Y10T 70/5416* (2015.04); *Y10T 70/5792* (2015.04); *Y10T 70/5832* (2015.04); *Y10T 70/625* (2015.04); *Y10T 70/65* (2015.04); *Y10T 70/7062* (2015.04); *Y10T 70/7068* (2015.04); *Y10T 70/7107* (2015.04); *Y10T 70/7113* (2015.04); *Y10T 70/7136* (2015.04); *Y10T 70/7441* (2015.04); *Y10T 292/57* (2015.04); *Y10T 292/91* (2015.04)

(56) References Cited

U.S. PATENT DOCUMENTS

| | | | | |
|---|---|---|---|---|
| 7,698,917 | B2 * | 4/2010 | Lie-Nielsen et al. | 70/143 |
| 8,079,240 | B2 * | 12/2011 | Brown et al. | 70/277 |
| 8,272,241 | B2 * | 9/2012 | Brown et al. | 70/277 |
| 2002/0056300 | A1 | 5/2002 | Pierre et al. | |
| 2002/0125992 | A1 * | 9/2002 | Harwood | 70/278.1 |
| 2003/0132829 | A1 | 7/2003 | Frolov et al. | |
| 2004/0025550 | A1 * | 2/2004 | Yamagishi | 70/278.1 |
| 2004/0089035 | A1 | 5/2004 | Ciezki et al. | |
| 2006/0238294 | A1 * | 10/2006 | Gokcebay et al. | 70/432 |
| 2007/0290793 | A1 | 12/2007 | Tran | |

* cited by examiner

ELECTRONIC DOOR LOCK WITH MODULAR COMPONENTS

RELATED APPLICATION

The present application claims the benefit of provisional patent application Ser. No. 61/076,476, filed Jun. 27, 2008, the subject matter of which is hereby fully incorporated by reference.

BACKGROUND

The present invention relates to access control systems, and more particularly to an electronic door lock used in an access control system.

Access control systems may be upgraded periodically. Upgrades may include newer versions of software, firmware, hardware, or a combination thereof. Upgrades may be performed as maintenance or for user preference. For example, a user may wish to change from an offline access control system to an online access control system. Alternatively, a user may wish to change from a wired access control system, in which all communication occurs over physical, wired connections, to a wireless system, in which some or all of the communication is performed wirelessly. Traditionally, an upgrade from a wired system to a wireless system would require the purchase of new electronic door locks with wireless capability.

As a user's needs change, it may be desirable to change other features of the access control system. For example, a user may wish to convert from a system that uses a keypad input to a system that uses a biometric input. Because locks are designed to function with a specific input device, a switch from one type of input device to a different type of input device generally requires the purchase of a new set of door locks. Thus, upgrading an access control system is often expensive and time consuming.

In one construction, the invention provides an electronic door lock that mounts to a door. The door includes an inner side and an outer side, and the electronic door lock is operable to control access to an access controlled area positioned adjacent the inner side of the door. The electronic door lock includes an outer base connected to the outer side of the door, an inner base connected to the inner side of the door, a locking mechanism coupled to the door and movable between a locked position and an unlocked position in response to a control signal, and a control circuit disposed within the inner base and operable to generate the control signal in response to an input credential. An attachment interface is at least partially formed as part of the outer base. Each of a plurality of different types of credential readers is selectively attachable and removable from the attachment interface when the outer base is attached to the door to electrically connect a selected one of the plurality of different types of credential readers to the control circuit to provide the input. A communication module is connected to the control circuit, and the communication module is operable to communicate with a device that is separate from the electronic door lock.

In another construction, the invention provides an electronic door lock that mounts to a door. The door includes an inner side and an outer side, and the electronic door lock is operable to control access to an access controlled area positioned adjacent the inner side of the door. The electronic door lock includes an outer base supported by the outer side, a locking mechanism coupled to the door and moveable between a locked position and an unlocked position, and a control circuit coupled to the door. The control circuit is configured to selectively move the locking mechanism between the locked position and the unlocked position to control access to the access controlled area. An attachment interface is coupled to the outer base and includes a mounting portion and a first connector that extends from the mounting portion. The first connector is in electrical communication with the control circuit. An outer escutcheon is supported by at least one of the outer base and the door. The outer escutcheon is positioned to substantially cover the outer base and includes an aperture positioned adjacent the attachment interface to expose the attachment interface. A credential reader includes a surface sized and shaped to generally correspond to the mounting portion and a second connector configured to mate with the first connector. The credential reader is removably mountable to the attachment interface to electrically connect the credential reader to the control circuit.

In yet another construction, the invention provides an electronic door lock that mounts to a door. The door includes an inner side and an outer side, and the electronic door lock is operable to control access to an access controlled area positioned adjacent the inner side of the door. The electronic door lock includes an inner base supported by the inner side, a locking mechanism coupled to the door and movable between a locked position and an unlocked position, and a control circuit coupled to the door. The control circuit is configured to selectively move the locking mechanism between the locked position and the unlocked position to control access to the access controlled area. A communication module is coupled to the control circuit to allow the electronic door lock to communicate with a device that is different from the electronic door lock, and the communication module is positioned in the inner base adjacent the inner side. The communication module is removably coupled to the control circuit and the inner base. An inner escutcheon is supported by at least one of the inner base and the door, and the inner escutcheon is positioned to substantially cover the inner base. The inner escutcheon includes an aperture positioned adjacent the communication module to expose the communication module and to allow the communication module to be removed and replaced through the inner escutcheon aperture. A cover is removably coupled to the inner escutcheon, and the cover and the inner escutcheon cooperate to close the inner escutcheon aperture and to cover the communication module.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
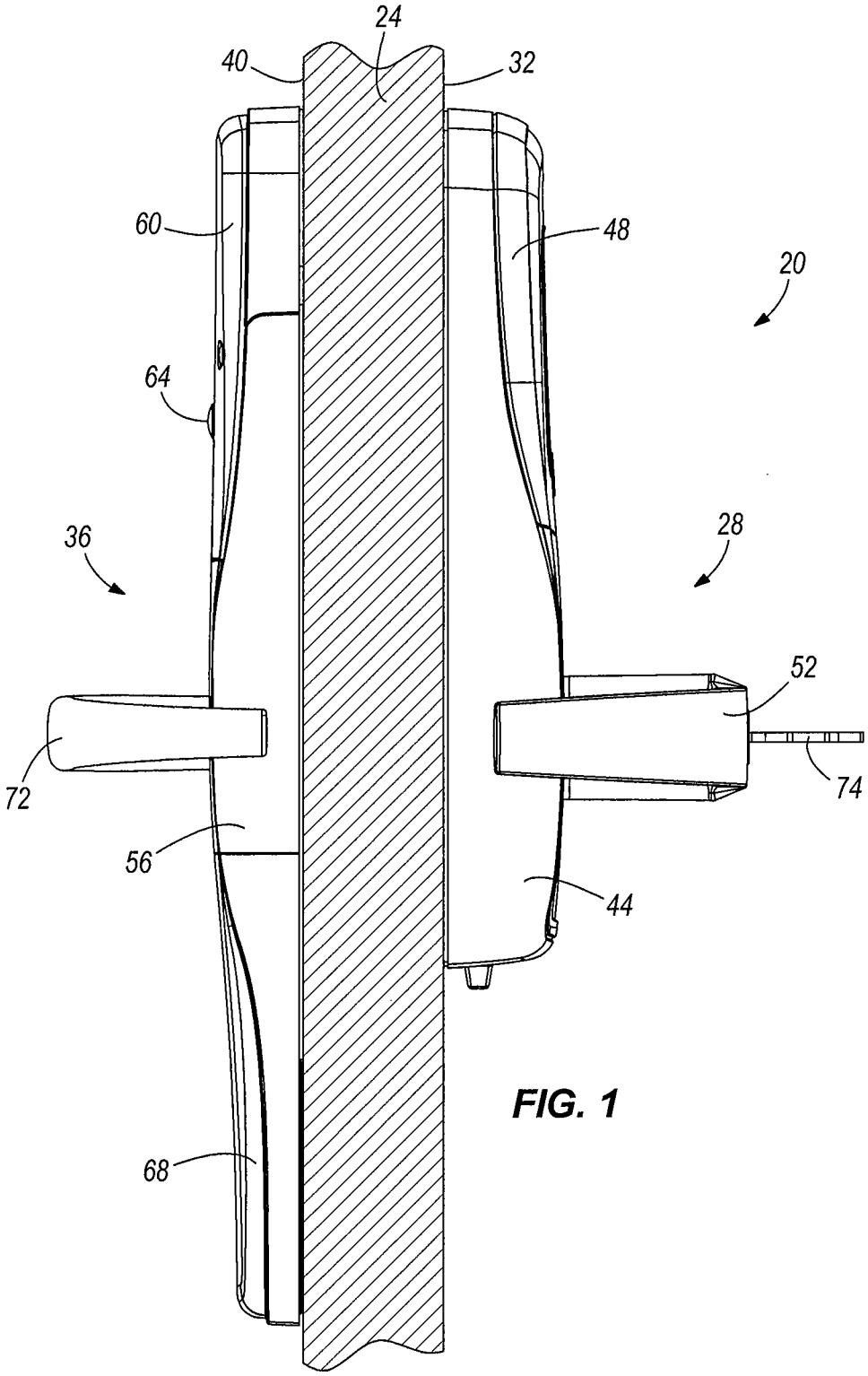
FIG. 1 is a side view of an electronic door lock mounted to a door.

FIG. 1 illustrates an electronic door lock 20 mounted to a door 24 and suitable for use in an access control system 27. The door lock 20 includes an outer portion 28 mounted on an outer side 32 of the door 24 and an inner portion 36 mounted on an inner side 40 of the door 24. The outer portion 28 of the door lock 20 includes an outer escutcheon 44, a credential reader 48, and an outer handle 52. The inner portion 36 of the door lock 20 includes an inner escutcheon 56, a communication module cover 60, an optional pushbutton 64, a battery cover 68, and an inner handle 72.

The terms "inner" and "outer" are used herein to differentiate the two sides of the door and should not be considered as limiting the invention in anyway. In constructions in which one side of the door is in a secured space and the other side of the door is not (e.g., an entry door into a building), the inner side would be in the secured space. However, some constructions may position a door within a space in which both sides of the door are located within a secure space. In these constructions, one side of the door would be considered the inner side while the opposite side would be the outer side. Thus, constructions are possible in which components or features described as being positioned on an inner side of the door could be positioned on an outer side of the door and visa versa. Thus, the terms "inner" and "outer" are sometimes replaced herein with "first" and "second".

Figure 9:
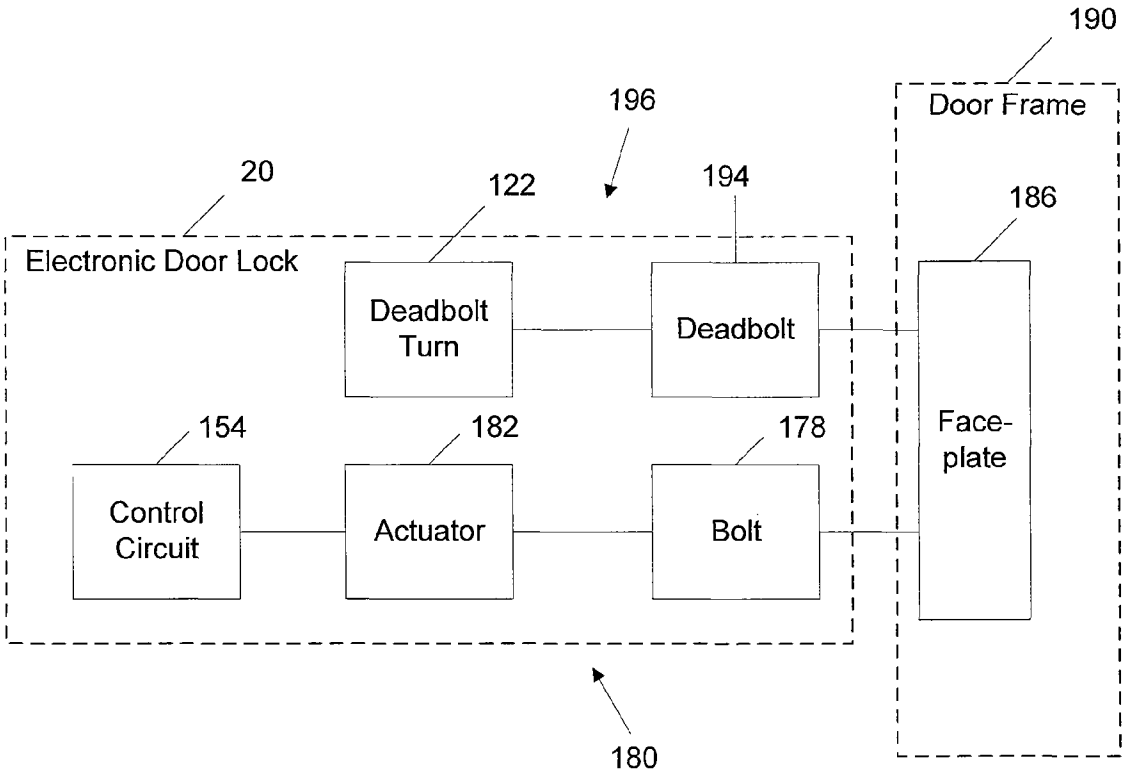
FIG. 9 is a schematic illustration of an electromechanical system of the door lock of FIG. 1.

The door lock 20 includes an electromechanical system that allows for the movement of a locking mechanism 180 including an actuator 182, a clutch 179, and a latch 178, which are schematically illustrated in FIG. 9. The latch 178 is movable by the inner handle 72 and the outer handle 52 between a locked position and an unlocked position. When the latch 178 is moved to the locked position, the latch 178 is extended away from the door lock 20 into an opening in a face plate 186 mounted to a door frame 190. The latch 178 inhibits movement of the door 24 when in the extended position. When the latch 178 is moved to the unlocked position, the latch 178 is retracted into the door lock 20 and out of engagement with the face plate 186 to allow a user to open the door 24.

The actuator 182 moves the clutch 179 between an engaged position and a disengaged position to selectively enable and disable the outer handle 52. When the clutch 179 is in the disengaged position, the clutch 179 disengages from the outer handle 52 and the latch 178 such that movement of the outer handle 52 does not cause movement of the latch 178. Thus, when the clutch 179 is in the disengaged position, a user positioned adjacent the outer side 32 cannot gain access to the inner side 40. When the clutch 179 is in the engaged position, the clutch 179 is engages with the outer handle 52 and the latch 178 such that movement of the outer handle 52 causes the latch 178 to move. Thus, when the clutch 179 is in the engaged position, a user positioned adjacent the outer side 32 can move the latch 178, open the door 24, and gain access to the inner side 40. The actuator 182 can include an electric motor, a solenoid, a piezoelectric actuator, a linear actuator, a mechanically actuated device, a different suitable actuator, or a combination thereof to move the clutch 179 to the desired position when a user uses an appropriate key 74 or presents an appropriate credential to the credential reader 48 to allow the user to operate the outer handle 52 and move the latch 178. In some constructions, the actuator 182 is configured to selectively enable and disable the inner handle 72 or both the inner and outer handle.

Figure 2:
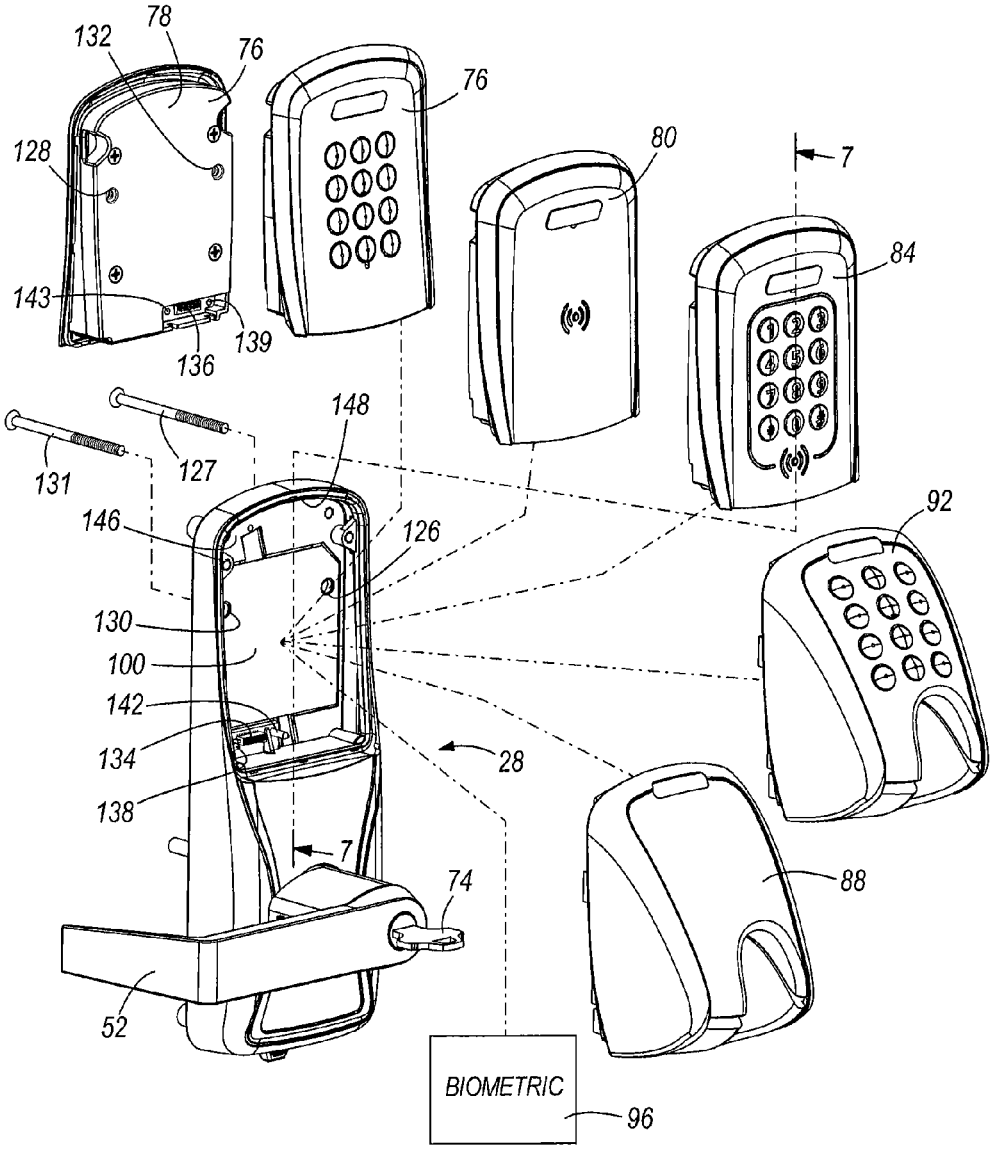
FIG. 2 is a schematic illustration of the electronic door lock of FIG. 1 and a plurality of credential readers configured for mounting on the electronic door lock.

FIG. 2 illustrates the outer portion 28 of the door lock 20. A plurality of input devices (also referred to as credential readers 48) are illustrated including but not limited to a keypad 76, a proximity detector 80, a proximity detector with built-in keypad 84, a magnetic stripe reader 88, a magnetic stripe reader with a built-in keypad 92, and a biometric reader 96. For clarity, the credential reader 48 could include any one of a keypad 76, a proximity detector 80, a proximity detector with built-in keypad 84, a magnetic stripe reader 88, a magnetic stripe reader with a built-in keypad 92, and a biometric reader 96 as well as other types of credential readers such as a smartcard reader, a smartcard reader with built-in keypad, a multitech reader, and a multitech reader with built-in keypad. In fact, the modularity of the arrangement described herein would allow for the use of virtually any type of credential reader desired. The credential readers may include other features such as audio beepers and visual interfaces that include light emitting diodes (LEDs). The credential readers 48 are configured to mount to a mounting portion of an attachment interface 100, which will be described in greater detail with respect to FIG. 4. Each credential reader 48 is self-contained and includes all the necessary electrical components and firmware required for the credential reader 48 to receive an input credential from a user and output the credential or a signal corresponding to the credential to a control circuit 154 (FIG. 9) of the door lock 20. For example, the keypad credential reader 76 is configured to receive a user input (e.g., a numeric or alphanumeric code) and output the entered credential to the control circuit 154 of the door lock 20. The biometric credential reader 96 is configured to receive a user input (e.g., a fingerprint, a scan of the user's hand, a vocal input, a scan of the user's face, a scan of the user's eye, or other biometric data), process the user input, and output data to the control circuit 154 that is representative of the user input. In some embodiments, the biometric credential reader 96 may receive user input in the form of a fingerprint and output the fingerprint data to the control circuit of the door lock 20. In other embodiments, the biometric credential reader 96 may process the input fingerprint and output a statistical representation of the fingerprint data or some other value representative of the fingerprint or the user that provided the fingerprint.

Figure 5:
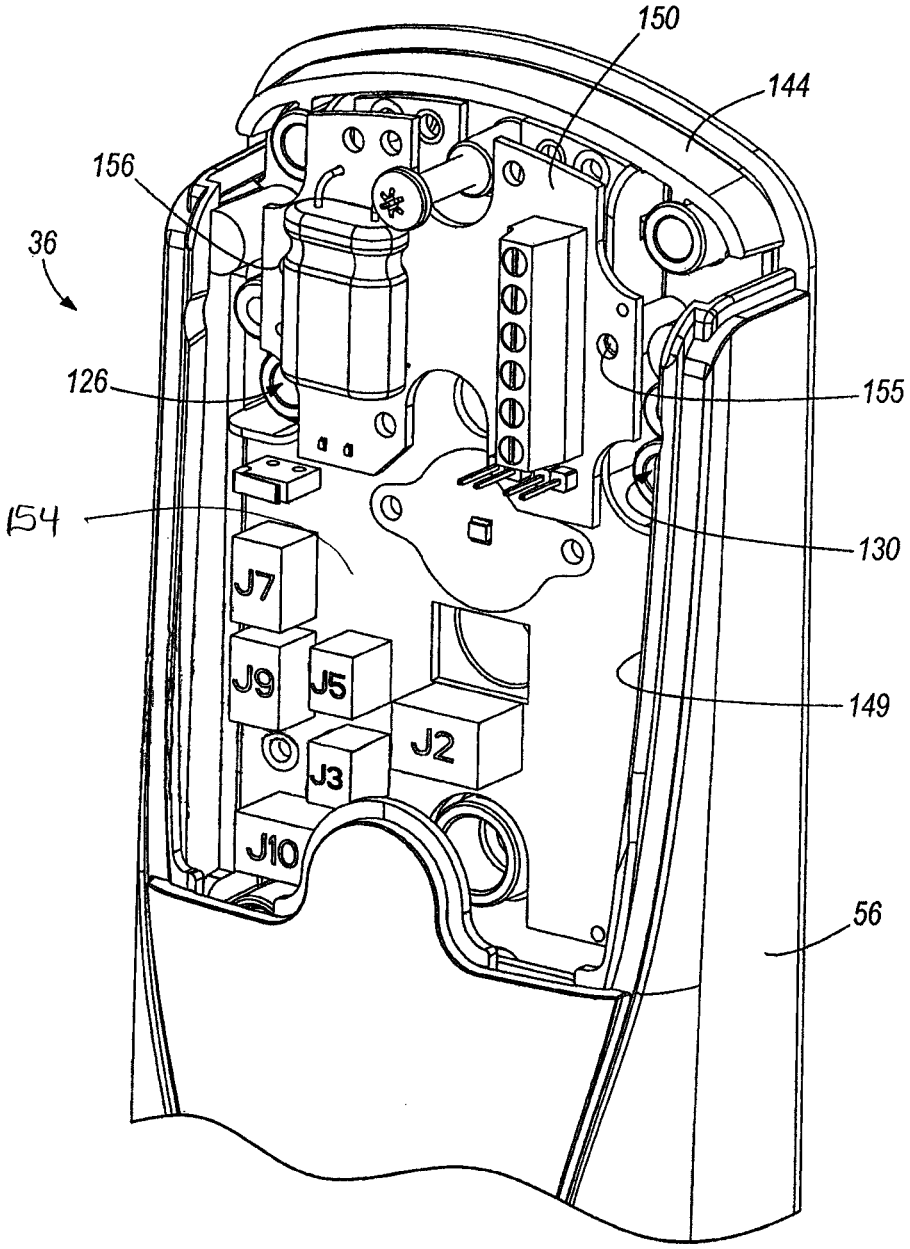
FIG. 5 is a perspective view of a portion of the electronic door lock of FIG. 1 illustrating a communication module.

The control circuit 154 of the door lock 20, shown in FIG. 5, includes software or firmware that is operable to receive a variety of credentials or other signals from a variety of different types of credential readers 48. Thus, the user has the option to purchase a door lock and separately purchase any of a variety of credential readers 48, some of which are illustrated in FIG. 2. The software of the control circuit 154 is configured to recognize the type of credential reader 48 attached to the door lock 20 and thus knows what input to expect from the credential reader 48. For example, if a keypad 76 is attached, the software expects a user code. If a magnetic stripe reader with a built-in keypad 92 is attached, the software may be configured to expect both a user code and a magnetic stripe input. The software is configured to receive a signal, from each of a plurality of different types of credential readers 48, that corresponds to the credential input by the user. Thus, no modification to the software is required when a user replaces one type of credential reader (e.g., keypad 76, proximity detection 80, magnetic stripe reader 88, biometric 96, etc.) with a different type of credential reader. Of course, modifications to the software may be performed as desired by the user.

As the user's security needs or preferences change, the user may purchase a new set of credential readers 48 to change the access control system from using one type of credential to a different type of credential. Thus, the user may selectively remove and attach desired credential readers 48 in the field (e.g., at the user's place of business). Of course, the credential readers 48 may also be selectively removed and attached at a factory or place of manufacture. In this way, the electronic door lock 20 contains a high degree of modularity, interchangeability, and upgradeability. Only some credential readers 48 are illustrated in FIG. 2 and discussed herein for exemplary purposes, and the invention is not limited to the types of credential readers 48 discussed and illustrated herein.

Figure 3:
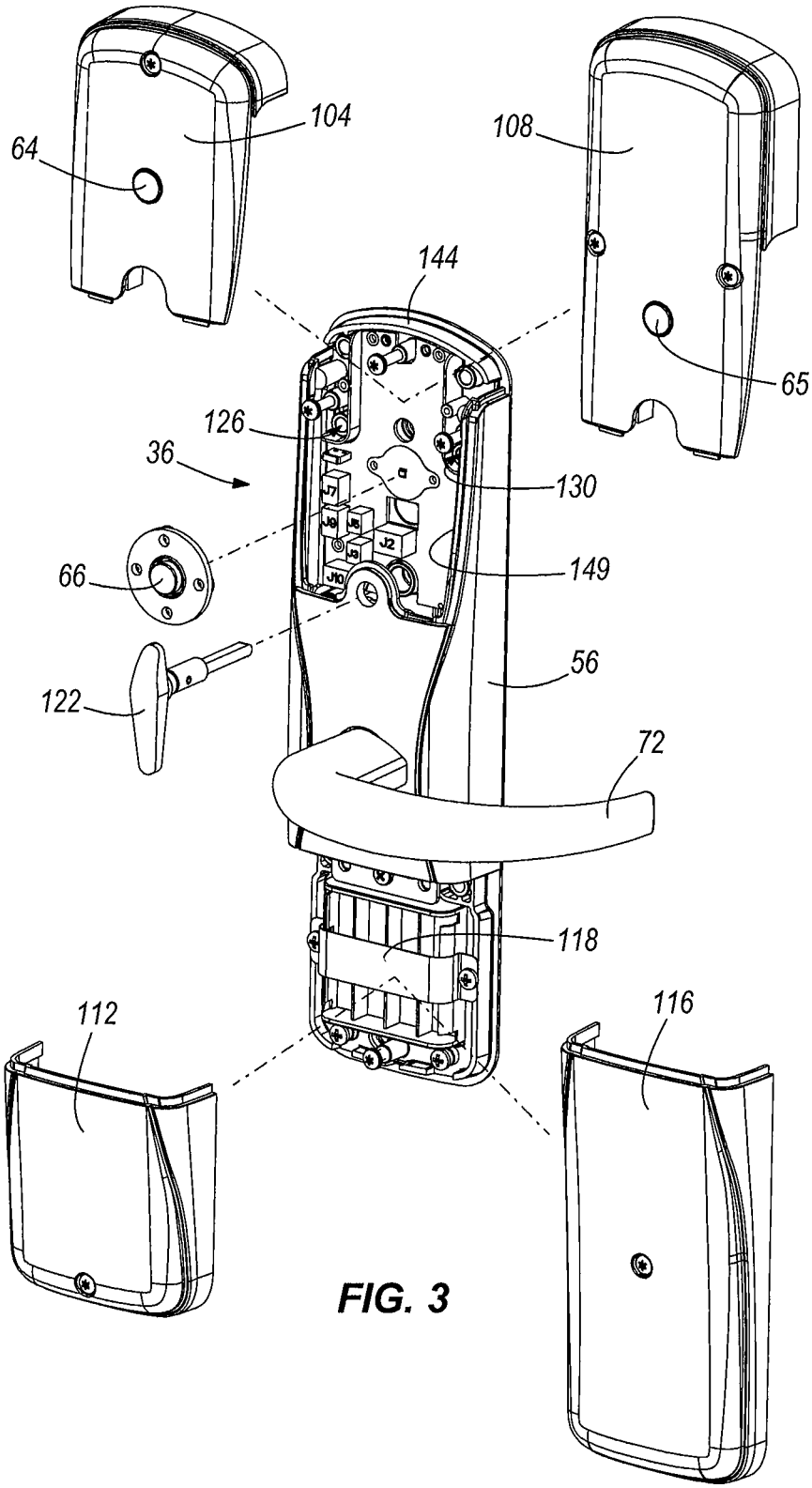
FIG. 3 is a schematic illustration of the electronic door lock of FIG. 1 and a plurality of communication module covers and a plurality of battery covers configured for mounting on the electronic door lock.

FIG. 3 illustrates the inner portion 36 of the door lock 20 which includes an inner base 144 and the inner escutcheon 56 that defines an inner escutcheon aperture 149. A plurality of communication module covers 104, 108 are illustrated. One cover 104 is configured to cover a wired communication module, and a second cover 108 is configured to cover a wireless communication module, which will be described in detail with respect to FIGS. 5 and 6. The covers 104 and 108 may also be used to substantially close or cover the inner escutcheon aperture 149 when no communication module is present (e.g., offline locks). A first battery cover 112 and a second battery cover 116 are configured to mount to the inner escutcheon 56 to cover the batteries and battery holder 118. A four-battery battery holder 118 is illustrated in FIG. 3, as the construction of FIG. 3 includes 4 batteries. However, if the user desires longer battery life or the credential reader 48 requires more power to operate, the user can use an eight-battery battery holder and mount battery cover 116 to the inner escutcheon 56 to cover the batteries and the battery holder. The eight-battery battery holder is formed by attaching a second four-battery battery holder to the door lock and connecting the second four-battery battery holder to the first four-battery battery holder 118 in order to create an eight-battery battery holder.

The inner portion 36 of the door lock 20 has an optional secondary locking mechanism 196 that includes a deadbolt turn 122 and a deadbolt 194. The deadbolt turn 122 is accessible from inside the access controlled area and is coupled to the deadbolt 194 to allow a user to move the deadbolt 194 (FIG. 9) from a locked position, in which it is extended and engaged in a second opening in the faceplate 186, to an unlocked position, in which the deadbolt 194 is retracted into the door lock 20 and out of engagement with the second opening in the faceplate 186. Thus, a user inside the access controlled area may turn the deadbolt turn 122 to move the deadbolt 194 into engagement with the opening in the faceplate 186, thus inhibiting other users from entering the access controlled area even when an appropriate key 74 is used or when appropriate credentials are presented.

The communication module covers 104, 108 include optional outer pushbuttons 64, 65 mounted to the communication module covers 104, 108, respectively. A corresponding internal button 66 is coupled to the inner base 144. When the cover is mounted on the inner escutcheon 56, the outer pushbutton 64 or 65 aligns with the corresponding internal button 66. When a user positioned inside the access controlled area pushes the pushbutton 64, 65, the corresponding internal button 66 is actuated and sends an electrical signal to the control circuit. The control circuit receives the signal and processes the signal. The internal button 66 may be configured for providing a privacy, lock, unlock, or other function. The control circuit may be programmed to ignore signals received from the pushbutton to effectively disable the pushbutton 66, or the control circuit may be programmed to change the operating mode of the door lock for some period of time or until a second signal is received. For example, the door lock may change from a standard mode of operation to a restricted access mode. When the pushbutton 66 is activated, the door lock 20 may only allow a select number of users to enter the access controlled area, temporarily denying assess to all others who present valid credentials. Of course, other operating modes are also possible and may be predefined and programmed into the electronic door lock software. If the communication module cover 104, 108 does not include an outer pushbutton 64, 65, then the corresponding internal button 66, while still present in the door lock 20, will not be actuatable during normal use.

Figure 4:
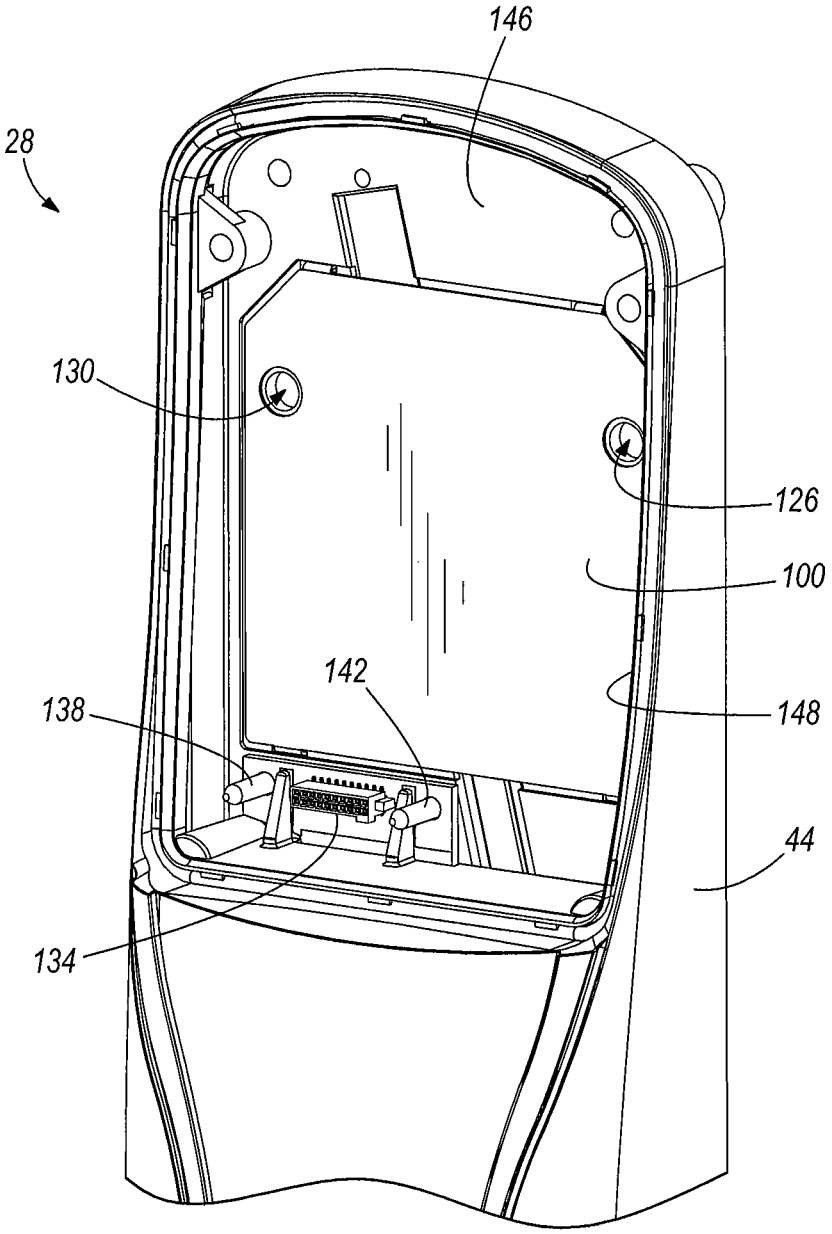
FIG. 4 is a perspective view of the electronic door lock of FIG. 1 including an attachment interface.

FIG. 4 illustrates the attachment interface 100 on the outer portion 28 of the door lock 20. The attachment interface 100 is substantially flat and includes mounting apertures 126, 130, a connector 134, and alignment posts 138, 142. The connector 134 extends from the attachment interface 100 in a direction away from the door. The illustrated connector 134 is a standard twenty pin female connector. Of course, in other embodiments, the connector 134 may be positioned in a different location on the attachment interface. In addition, the connector may be a different connector, such as an 8 pin connector, a male connector, or other suitable connectors. In addition, the attachment interface 100 may be a different shape or size if desired.

The credential reader 48, such as one of the credential readers 76, 80, 84, 88, 92, 96 illustrated in FIG. 2 is designed with a corresponding attachment portion 78 and is removably mounted to the attachment interface 100 of the door lock 20. The credential reader 48 includes a second connector 136 that mates with the first connector 134 when the credential reader 48 is mounted on the attachment interface 100. The alignment posts 138, 142 are received in corresponding apertures 139, 143, respectively, in the credential reader 48 to aid in the alignment of the connector 134 of the credential reader 48. Once the credential reader 48 is positioned on the attachment interface 100, mounting fasteners 127, 131 are inserted from the inner side 40 of the door 24. The mounting fasteners 127, 131 pass through apertures 126, 130 and are threadably received in threaded apertures 128, 132 in the credential reader 48 to secure the credential reader 48 to the door lock 20. Because the mounting fasteners 127, 131 secure the credential reader 48 from the inside of the door 24, there is no access to the fasteners 127, 131 from the outer portion 28 of the lock 20 and security is increased. In other embodiments, the attachment interface 100 may include fewer or more alignment posts, differently shaped or positioned alignment posts, or no alignment posts whatsoever. Of course, the attachment interface 100 may include more or less apertures and more or less mounting fasteners if desired. It should be noted that other alignment features could also be employed as alignment posts. In addition, the alignment posts could be formed on the credential readers 48, with corresponding apertures formed in the door lock 20 to facilitate alignment and attachment.

FIG. 5 illustrates a wired communication module 150 that may be used with the door lock 20 of FIG. 1. The inner base 144 is mounted to the inner side 40 of the door. The control circuit 154 is positioned in the inner base 144 and may include electrical components 154 such as an integrated circuit, central processing unit, memory, etc. The wired communication module 150 is removably mounted on the inner base 144 and is electrically connected to the control circuit 154. The wired communication module 150 communicates using wired communications such as serial communication, RS-485, RS-232, Ethernet, etc. The wired communication module 150 is secured to the inner base 144 by inserting fasteners through apertures 155 and 156. The cover 104 illustrated in FIG. 2 is configured to mount to the inner escutcheon 56 to substantially cover the wired communication module and an antenna. Of course, in other constructions, the wired communication module 150 may be used with non-lock devices including but not limited to panel interface modules, wireless reader interfaces, wireless status monitors, wireless portable readers and the like.

Figure 6:
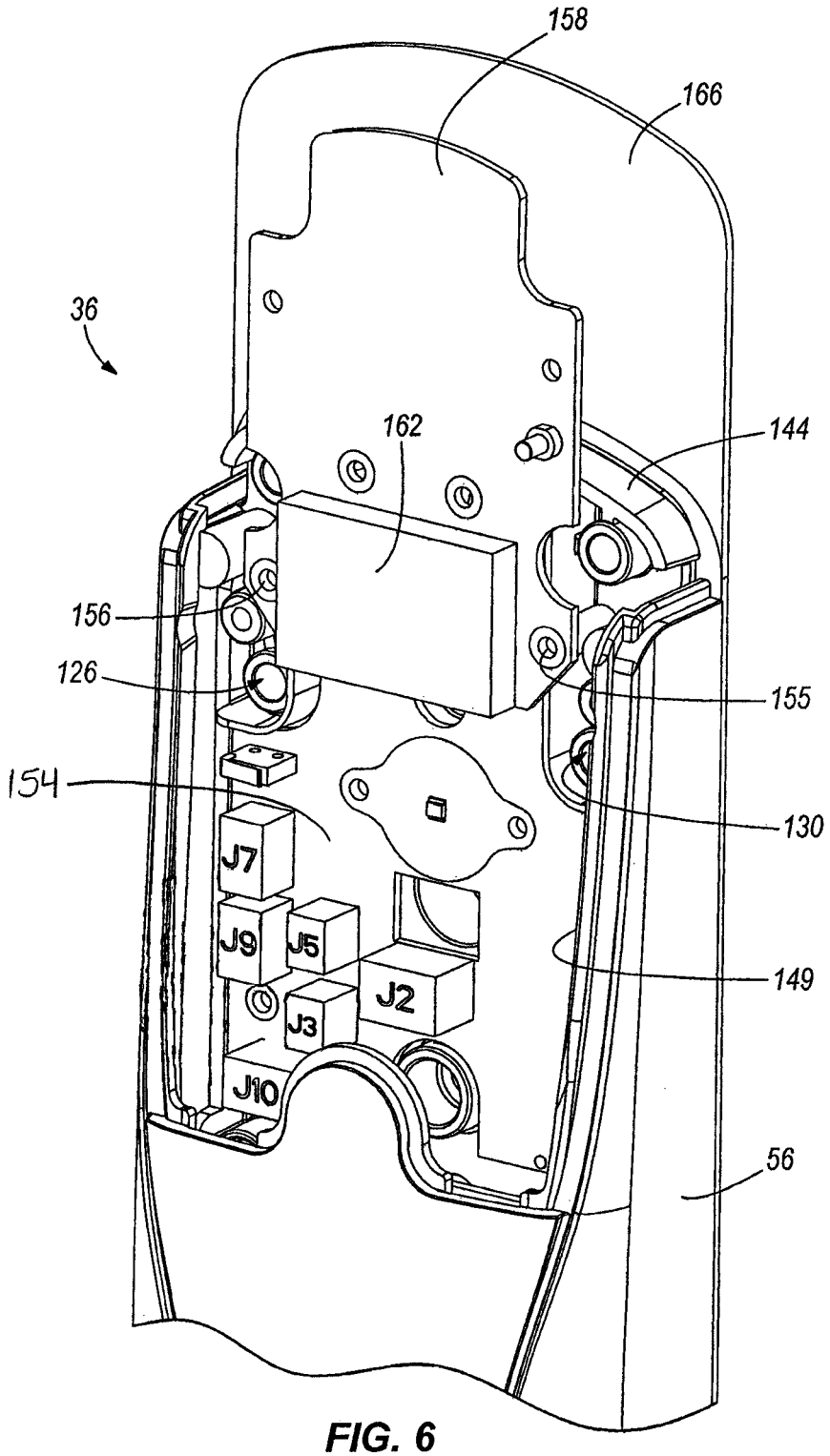
FIG. 6 is a perspective view of a portion of the electronic door lock of FIG. 1 illustrating another construction of a communication module.

If a user wishes to change to, for example, a wireless communication module 158, the user may remove the cover 104 to gain access to the communication module 150. Easy access is granted to the wired communication module 150 through the inner escutcheon aperture 149, and the wired communication module 150 may be removed by removing fasteners in apertures 155 and 156. The wireless communication module 158 may be mounted in the same position to provide wireless capability to the door lock 20, as illustrated in FIG. 6. Thus, the wired communication module 150 may be removed and replaced from the lock without removing the inner escutcheon 56 and without damaging or disturbing the control circuit 154 and the locking mechanism 180.

With reference to FIG. 6, the wireless communication module 158 is removably mounted on the inner base 144 and is electrically connected to the control circuit 154 when mounted thereon. The wireless communication module 158 includes a radio frequency ("RF") shield 162 and additional circuitry, such as a wireless transmitter or transceiver and the antenna to wirelessly communicate with other devices. Thus, the wireless communication module 158 is larger than the wired communication module 150. As illustrated in FIG. 6, the wireless communication module 158 extends above the inner portion 36 of the door lock 20. A metallic extension 166 is positioned adjacent the door 24 and extends above the door lock 20 a distance that is similar to the wireless communication module 158. The metallic extension 166 contains an adhesive layer for mounting to the door 24. The metallic extension 166 ensures a consistent RF radiation pattern when the door 24 is formed of wood or metal. The RF shield 162 is provided between the wireless communication module 158 and the cover 108 when the cover 108 is mounted on the inner escutcheon 56 to substantially cover the communication module 158. The wireless communication module cover 108 is larger than the wired communication module cover 104 to accommodate the larger wireless communication module 158. In this manner, the inner portion 36 of the door lock is able to accommodate substantially any size of communication module provided that the module is configured to mount to the inner base 144 in a similar position and a cover is designed to mate with the inner escutcheon 56 to substantially cover the communication module. Thus, the door lock 20 is configured to accept a variety of communication modules that are interchangeable, providing the door lock 20 with a greater modularity, flexibility, and interchangeability.

The wireless communication module 158 can be configured to communicate using 900 MHz, WIFI, ZIGBEE, Z-wave, 2.4 GHz, 868 MHz, other radio frequencies, and other standards as desired. The wireless communication module 158 may also be used in non-lock devices such as panel interface modules, wireless portable readers, wireless reader interfaces, wireless status monitors or other wireless devices used in the access control system 27. In offline locks, a communication module is not present. However, the offline lock still includes sufficient space for the addition of a communication module should one be desired. The user can convert to an online wired or wireless lock simply by attaching the wired communication module 150 or the wireless communication module 158 as described above.

Figure 7:
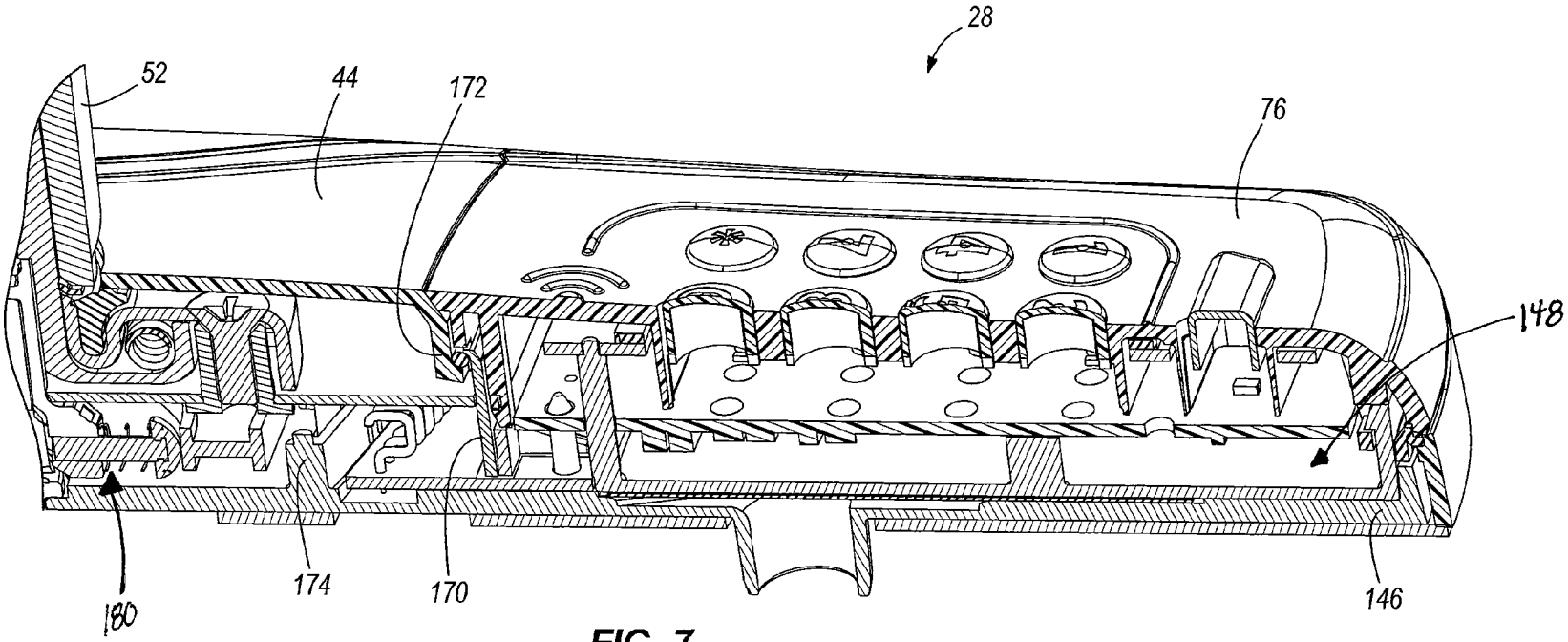
FIG. 7 is a sectional view of the electronic door lock of FIG. 1 taken along line 7-7 of FIG. 2.

With reference to FIG. 7, the outer portion 28 of the door lock 20 includes a first anti-tamper wall 170 and a second anti-tamper wall 174 that inhibit access to the locking mechanism 180 from the outer portion 28 of the door lock. Specifically, the anti-tamper walls 170 and 174 are positioned to inhibit access to the locking mechanism 180 from an outer escutcheon aperture 148 in the outer escutcheon 44. The first anti-tamper wall 170 extends in a horizontal direction from the outer base 146 to a flange 172 of the outer escutcheon 44 to provide a horizontal barrier between the locking mechanism 180 and the aperture 148. Thus, if an intruder breaks the credential reader 76 and gains access to the upper portion of the door lock 20, the intruder's access to the locking mechanism 180 is blocked by the first anti-tamper wall 170. To increase security, a second anti-tamper wall 174 is positioned below the first anti-tamper wall 170 to provide a second barrier between the upper portion of the door lock 20 and the locking mechanism 180. The second anti-tamper wall 174 extends horizontally from the outer base 146 to at least partially block access to the locking mechanism 180.

Figure 8:
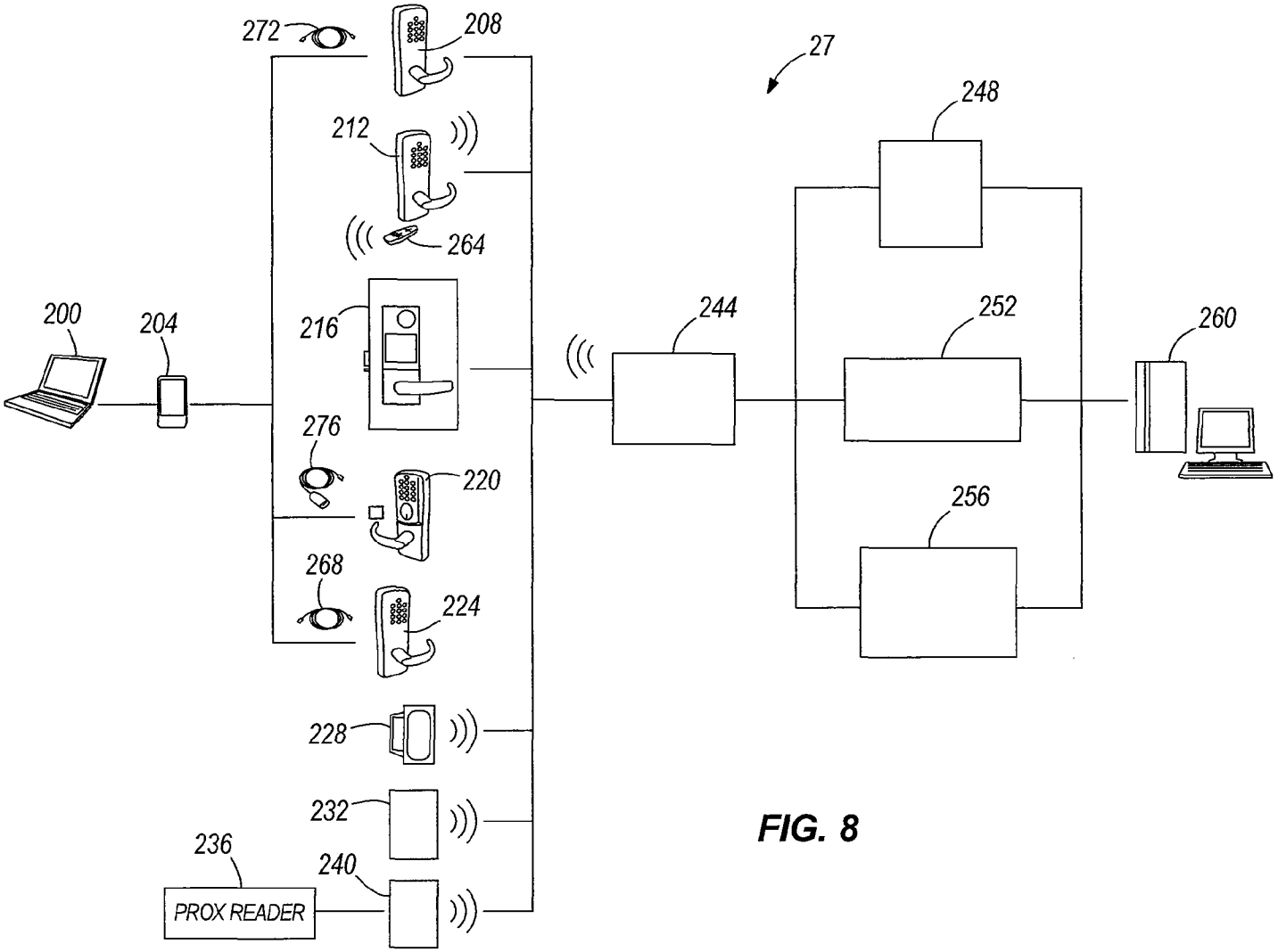
FIG. 8 is a schematic illustration of an access control system including the electronic door lock of FIG. 1.

FIG. 8 schematically illustrates an access control system 27 that may include the electronic door lock 20 of FIGS. 1-7. The system includes an optional laptop computer 200, a personal device assistant (PDA) 204, a plurality of door locks and communication modules 208, 212, 216, 220, 224, 228, 232, 236, 240, a panel interface device 244 (e.g., panel interface board (PIB) or panel interface module (PIM)), an access control panel (ACP) 248, 252, or 256, and a server 260.

The laptop 200 and PDA 204 may be used to configure parameters in the access control system 27. The door locks 208, 212, 216, 220, 224 may include one type of door lock or a plurality of types of door locks (e.g., online or offline locks, mortise locks, cylindrical locks, exit locks, etc). The door locks may include wireless credential readers, wired credential readers or a combination thereof. In addition, the access points (e.g., doors, gates, elevators, etc.) may include proximity readers 236, a wireless reader interface (WRI) 240, a wireless status monitor (WSM) 232, a wireless portable reader (WPR) 228, a universal serial bus (USB) enabled electronic lock 224, an electronic lock including a standard electrical connection 220, a BLUETOOTH enabled lock 212 with corresponding dongle 264, or other devices not listed herein. The laptop 200, PDA 204, or a combination thereof may be used during installation and upgrades of the access control system 27. For example, if the door locks require a software upgrade, the upgrade may be performed through the laptop 200 or PDA 204. The laptop 200 and PDA 204 may communicate wirelessly with the door locks or through a wired connection such as a USB cable 268, 272 or other electrical connection 276.

The door locks and communication modules 208, 212, 216, 220, 224, 228, 232, 236, 240 are configured to communicate with the panel interface device 244. The communication may be wireless, with the use of a wireless communication module 158, or the communication may be wired, with the use of a wired communication module 150. The panel interface device 244 is configured to communicate with the ACP 248 via a wired connection. In other constructions, the panel interface device 244 may communicate with third party original equipment manufacture (OEM) equipment 256 or a different control panel, such as BRIGHT BLUE 248. The ACP 252 is configured to communicate with a server 260 such as SMS Express, Select Premium Enterprise system (S/P/E), other software packages, and other third party OEM software and servers. The access control decision may be made by any of the control circuit 154, the panel interface device 244, the ACP 252, 248, or 256, and the server 260. It is also contemplated that the access control decision may be made in the credential reader or the lock itself.

When a user desires access to the access controlled area, the user approaches the credential reader 48, which is positioned on the outer portion 28 of the door lock 20. The user uses the credential reader 48 to enter credentials. This could include entering a pin, swiping a card, providing a biometric sample and the like. The credential reader 48 provides the received credentials or a signal including data representative of the received credentials to the control circuit 154. The control circuit 154 may include an onboard database that has been previously saved and that includes a list of authorized users and the credentials or data associated with each user. The control circuit 154 determines if the received credentials or representative data are valid and makes an access decision. Alternatively, the control circuit 154 may transmit the data to the access control panel 248, 252, or 256, either directly or through the panel interface device 244. The access control panel 248, 252, or 256 may include a database that the access control panel 248, 252, or 256 uses to make an access decision, or the access control panel 248, 252, or 256 may communicate directly with a server 260 that makes the access decision. One of the server 260, access control panel 248, 252, or 256, and the control circuit 154 generates a control signal in response to the access decision.

The control signal is communicated to the control circuit 154, and the control circuit 154 processes the control signal and uses the control signal to actuate the locking mechanism 180 to enable the outside lever and allow the outer handle 52 to move latch 178 to one of the locked position and the unlocked position to provide or inhibit access to the access controlled area. If the control circuit 154 generates the control signal, then the control circuit 154 uses the control signal to operate the locking mechanism 180 accordingly.

The modular design of the electronic door lock 20 provides users with flexibility and an easier way to manage repairs and upgrades of the door locks 20. The user may purchase credential readers 48 separately from the door lock 20. Thus, if a user wishes to change an access control system 27 that uses, for example, keypad credential readers 76 to an access control system that uses, for example, biometric credential readers 96, the user can purchase biometric credential readers 96 for each of the door locks 20. The keypad credential readers 76 can be removed and replaced with the biometric credential readers 96. Because the control circuit 154 includes the necessary software to receive, for example, both keypad credential data and biometric data, no software modification is required. After the biometric credential reader 96 is mounted to the door lock 20 and the appropriate databases are updated with the users biometric data, the access control system 27 will function properly.

For example, some users may wish to change from a security system 27 with keypad entry to a biometric security system 27. To achieve the desired change, the following steps may be performed. The user removes the communication module cover 104 from the inside portion 36 of the door lock 20 (FIG. 3). The user removes the fasteners 127, 131 from the apertures 126 and 130 (FIGS. 2 and 3), the keypad 76 is removed from the attachment interface 100 in the outer portion 28 of the door lock 20, and the biometric credential reader 96 is mounted to the attachment interface 100. The fasteners 127, 131 are reinserted in the apertures 126 and 130 to secure the biometric credential reader 96 to the door lock 20. The communication module cover 104 may then be replaced on the inside portion 36 of the door lock 20.

In some situations, a user may want to change from a wired security system 27 to a wireless security system 27. To do this, the wired communication module 150 (FIG. 5) is removed by removing fasteners from apertures 155 and 156. The metallic extension 166 is mounted to the inner side 40 of the door 24. In some embodiments, the metallic extension 166 is provided with an adhesive backing and a removable film. The film is removed to expose the adhesive, and the metallic extension 166 is mounted to the inside of the door 24 above the inner base 144. The wireless communication module 158 (FIG. 6) is mounted to the door lock 20, and the fasteners are inserted in the apertures 155 and 156 to secure the wireless communication module 158 thereto. The communication module cover 108 is positioned over the wireless communication module 158 and is received by the inner escutcheon 56. The fasteners are replaced in the apertures 155 and 156 to secure the cover 108 to the door lock 20. Of course, the above steps may be performed in a different order. Thus, the communication module 150 or 158 is removable and replaceable without any disassembly of, or damage to the locking mechanism 180, the inner base 144, and the inner escutcheon 56. Furthermore, the communication module 150 or 158 is removable and replaceable without disturbing the control circuit 154 or the locking mechanism 180.

Thus, the invention provides, among other things, an electronic door lock that offers a greater degree of flexibility, interchangeability, and upgradeability. Various features and advantages of the invention are set forth in the following claims.

We claim:

1. An electronic door lock that mounts to a door, the door including an inner side and an outer side and the electronic door lock operable to control access to an access controlled area positioned adjacent the inner side of the door, the electronic door lock comprising:

an outer base connected to the outer side of the door;

an inner base connected to the inner side of the door;

a locking mechanism coupled to the door and movable between a locked position and an unlocked position in response to a control signal;

a control circuit disposed within the inner base and operable to generate the control signal in response to an input credential;

an attachment interface at least partially formed as part of the outer base;

a plurality of different types of credential readers each selectively attachable and removable from the attachment interface when the outer base is attached to the door to electrically connect a selected one of the plurality of different types of credential readers to the control circuit to provide the input, each of the credential readers being fully supported by the outer base when attached to the attachment interface;

a communication module connected to the control circuit, the communication module operable to communicate with a device that is separate from the electronic door lock;

a first anti-tamper wall positioned between the attachment interface and the locking mechanism to inhibit access to the locking mechanism from the attachment interface; and a second anti-tamper wall positioned between the first anti-tamper wall and the locking mechanism to inhibit access to the locking mechanism.

2. The electronic door lock of claim 1, wherein the communication module is operable to communicate with a device that is separate from the electronic door lock through one of a wired connection and a 900 Megahertz, WIFI, ZIGBEE, Z-Wave, and 2.4 Gigahertz wireless connection.

3. The electronic door lock of claim 1, wherein the plurality of different types of credential readers includes a keypad, a proximity detector, a proximity detector with built-in keypad, a magnetic stripe reader, a magnetic stripe reader with built-in keypad, and a biometric reader.

4. The electronic door lock of claim 3, wherein the control circuit includes software or firmware operable to receive an input from each of the keypad, the proximity detector, the proximity detector with built-in keypad, the magnetic stripe reader, the magnetic stripe reader with built-in keypad, and the biometric reader and to generate the control signal in response to the input.

5. The electronic door lock of claim 1, wherein the communication module is one of a wired communication module and a wireless communication module, each of the wired communication module and the wireless communication module being selectively removable and replaceable without disturbing the locking mechanism and without disturbing the control circuit.

6. An electronic door lock that mounts to a door, the door including an inner side and an outer side and the electronic door lock operable to control access to an access controlled area positioned adjacent the inner side of the door, the electronic door lock comprising:

an outer base connected to and supported by the outer side;

an inner base supported by the inner side;

a locking mechanism coupled to the door and moveable between a locked position and an unlocked position;

a control circuit disposed within the inner base and configured to selectively move the locking mechanism between the locked position and the unlocked position to control access to the access controlled area;

an attachment interface coupled to the outer base and including a mounting portion and a first connector that extends from the mounting portion, the first connector in electrical communication with the control circuit;

a first anti-tamper wall positioned between the attachment interface and the locking mechanism to inhibit access to the locking mechanism from the attachment interface;

a second anti-tamper wall positioned between the first anti-tamper wall and the locking mechanism to inhibit access to the locking mechanism;

an outer escutcheon supported by at least one of the outer base and the door, the outer escutcheon positioned to substantially cover the outer base and including an aperture positioned adjacent the attachment interface to expose the attachment interface; and a credential reader that includes a surface sized and shaped to generally correspond to the mounting portion and a second connector configured to mate with the first connector, the credential reader removably mountable to the attachment interface to electrically connect the credential reader to the control circuit, such that when the credential reader is mounted to the attachment interface, the outer base fully supports the credential reader and when the credential reader is not mounted to the attachment interface, the outer base remains connected to the outer side of the door.

7. The electronic door lock of claim 6, wherein the mounting portion is substantially flat.

8. The electronic door lock of claim 7, wherein the second connector is positioned within a recess in the surface.

9. The electronic door lock of claim 6, wherein one of the outer base and the credential reader includes an alignment pin and the other of the outer base and the credential reader includes a receiving aperture positioned to receive the alignment pin when the credential reader is mounted to the attachment interface.

10. The electronic door lock of claim 6, wherein the outer base further includes an anti-tamper wall positioned between the outer escutcheon aperture and the locking mechanism to inhibit access to the locking mechanism from the outer escutcheon aperture.

11. The electronic door lock of claim 6, wherein the control circuit includes software configured to receive an input from the credential reader.

12. The electronic door lock of claim 11, wherein the credential reader is one of a plurality of different types of credential readers, and wherein the control circuit is configured to receive a signal from each of the plurality of credential readers that corresponds to a credential input by a user.

13. The electronic door lock of claim 12, wherein the plurality of credential readers includes at least three of a keypad, a proximity detector, a proximity detector with built-in keypad, a magnetic stripe reader, a magnetic stripe reader with a built-in keypad, and a biometric reader.

14. The electronic door lock of claim 6, wherein the credential reader is attached to the attachment interface using fasteners that are only accessible from the inner side of the door.

15. The electronic door lock of claim 6, wherein the locking mechanism includes a handle coupled to the door, a latch moveable between an extended position and a retracted position, and a clutch that engages the handle and the latch when the locking mechanism is in the unlocked position and disengages the handle and the latch when the locking mechanism is in the locked position.

16. The electronic door lock of claim 6, further including:

a communication module coupled to the control circuit that allows the electronic door lock to communicate with a device that is different from the electronic door lock, the communication module positioned in the inner base and removably coupled to the control circuit;

an inner escutcheon supported by at least one of the inner base and the door, the inner escutcheon positioned to substantially cover the inner base and including an aperture positioned adjacent the communication module to expose the communication module and to allow the communication module to be removed and replaced through the inner escutcheon aperture; and a cover removably coupled to the inner escutcheon, the cover and the inner escutcheon cooperating to close the inner escutcheon aperture and to cover the communication module.

17. An electronic door lock that mounts to a door, the door including an inner side and an outer side and the electronic door lock operable to control access to an access controlled area positioned adjacent the inner side of the door, the electronic door lock comprising:

a locking mechanism coupled to the door and moveable between a locked position and an unlocked position;

an attachment interface coupled to the outer side and including a mounting portion;

one of a keypad, proximity detector, proximity detector with built-in keypad, magnetic stripe reader, magnetic stripe reader with built-in keypad, and biometric reader, each of the keypad, proximity detector, proximity detector with built-in keypad, magnetic stripe reader, magnetic stripe reader with built-in keypad, and biometric reader removably mountable to the mounting portion such that the attachment interface fully supports the one of the keypad, proximity detector, proximity detector with built-in keypad, magnetic stripe reader, magnetic stripe reader with built-in keypad, and biometric reader;

a control circuit coupled to the door and configured to selectively move the locking mechanism between the locked position and the unlocked position to control access to the access controlled area, the control circuit including software or firmware operable to receive an input from each one of the keypad, proximity detector, proximity detector with built-in keypad, magnetic stripe reader, magnetic stripe reader with built-in keypad, and biometric reader;

an outer base supported by the outer side, wherein the attachment interface is coupled to the outer base, and further including a first anti-tamper wall positioned between the attachment interface and the locking mechanism to inhibit access to the locking mechanism from the attachment interface; and a second anti-tamper wall positioned between the first anti-tamper wall and the locking mechanism to inhibit access to the locking mechanism.

18. The electronic door lock of claim 17, wherein the attachment interface further includes a first connector that extends from the mounting portion, the first connector in electrical communication with the control circuit, wherein each of the keypad, proximity detector, proximity detector with built-in keypad, magnetic stripe reader, magnetic stripe reader with built-in keypad, and biometric reader includes a second connector configured to mate with the first connector.

19. The electronic door lock of claim 17, wherein the locking mechanism includes a handle coupled to the door, a latch moveable between an extended position and a retracted position, and a clutch that engages the handle and the latch when the locking mechanism is in the unlocked position and disengages the handle and the latch when the locking mechanism is in the locked position.

* * * * *